US006880799B2

(12) United States Patent
Mrozek

(10) Patent No.: US 6,880,799 B2
(45) Date of Patent: Apr. 19, 2005

(54) SELF-ADJUSTING SYSTEM FOR A DAMPER

(75) Inventor: Greg T. Mrozek, Brooklyn Park, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/633,333

(22) Filed: Aug. 1, 2003

(65) Prior Publication Data

US 2005/0048911 A1 Mar. 3, 2005

(51) Int. Cl.[7] ..... G05B 13/00
(52) U.S. Cl. ..... 251/129.12; 700/277
(58) Field of Search ..... 700/276, 277, 700/56; 251/129.01, 129.04, 129.11, 129.12; 324/207.2

(56) References Cited

U.S. PATENT DOCUMENTS

| | | | | |
|---|---|---|---|---|
| 4,243,174 A | | 1/1981 | Moeller et al. | |
| 4,829,447 A | * | 5/1989 | Parker et al. | 700/277 |
| 4,843,084 A | * | 6/1989 | Parker et al. | 700/277 |
| 4,914,566 A | * | 4/1990 | Steutermann | 700/56 |
| 4,931,948 A | * | 6/1990 | Parker et al. | 700/277 |
| 5,443,420 A | | 8/1995 | Dong et al. | |
| 5,876,014 A | * | 3/1999 | Noritake et al. | 251/129.12 |
| 2003/0213852 A1 | | 11/2003 | Demster | |
| 2003/0213853 A1 | | 11/2003 | Demster | |
| 2004/0007001 A1 | | 1/2004 | Demster | |
| 2004/0007627 A1 | | 1/2004 | Demster | |

FOREIGN PATENT DOCUMENTS

| | | |
|---|---|---|
| EP | 0541864 A | 5/1993 |
| EP | 0611107 A | 8/1994 |
| EP | 1195276 A | 4/2002 |

OTHER PUBLICATIONS

"Small Precision Motors–PM42L–048," *Minebea Electronics Co., Ltd.*, 1 pg. (©2001–2002).

* cited by examiner

*Primary Examiner*—Harold Joyce

(57) ABSTRACT

A damper unit for an air handling system. The damper unit includes a damper vane to regulate air flow, and a position indicator coupled to the vane. The damper also includes a sensing device that senses when the position indicator passes in close proximity thereto. A controller receives an index signal from the sensing device when the device detects the position indicator, and the controller resets a home position for the vane upon receipt of the index signal. The home position for the vane can be reset upon initialization of the damper and periodically thereafter, such as after each complete revolution of the vane.

15 Claims, 22 Drawing Sheets

SELF-ADJUSTING SYSTEM FOR A DAMPER

TECHNICAL FIELD

The present invention generally relates to heating, ventilating, and air-conditioning systems. In addition, the present invention relates to damper devices and positioning systems for vanes of damper devices for use in controlling air flow in an air circulation system.

BACKGROUND

Heating, ventilating, and air-conditioning (HVAC) systems are commonly used to condition the air inside commercial and residential buildings. A typical HVAC system includes a furnace to supply heated air and an air-conditioner to supply cooled air to the building.

A system of ducts is typically used to route the heated or cooled air from the furnace or air-conditioner to various points within the building. For example, supply ducts can be run from an air-conditioner to one or more rooms in a building to provide cooled air to the rooms. In larger buildings, the ducts typically terminate in the space above a false ceiling, and a diffuser assembly is positioned within the false ceiling to deliver the conditioned air from the duct into the room of the structure. In addition, return ducts can be used to return air from the rooms to the air-conditioner or furnace for cooling or heating.

Damper assemblies are commonly used to control air flow through HVAC ducts. For example, a damper assembly can be used to restrict air flowing through a duct until the HVAC system determines that conditioned air needs to be provided to a room within the structure. The HVAC system can then, for example, turn on the air-conditioner blower and open the damper assembly to allow air to be forced through the duct and diffuser assembly into the room.

In large structures such as office buildings, the building can be divided into a series of zones so that conditioned air is only provided to a specific zone as needed. For example, each zone can include its own series of ducts, and damper assemblies can be positioned at a source of each series of ducts to open and close as necessary to deliver conditioned air to one or more of the ducts. In this manner, separate zones can be conditioned separately as desired.

While existing HVAC systems effectively provide conditioned air throughout a structure, such systems can be expensive to build and maintain. For example, initially duct work must be run from the HVAC system source (e.g., furnace or air-conditioner) to each separate point at which conditioned air is to be provided. Further, depending on how each "zone" within a structure is configured, it may be difficult to provide desired conditioning to a specific area of a building. For example, if the zones are too large in size, it may be difficult to provide the correct mixture of conditioned air for a given zone. In addition, if the rooms within a building are reconfigured after the HVAC system has been installed, it may be necessary to reroute existing duct work to provide a desired level of conditioning for the new configuration of rooms.

To overcome the problems associated with conventional HVAC systems, a so-called "duct-less" HVAC system has been developed. FIG. 1 schematically shows an example of this type of system 100. The system 100 includes an air supply plenum 120, an air return plenum 130, and a conventional air conditioning unit 110. The air supply plenum 120 is positioned above a floor space 159 desired to be cooled, and is separated from the floor space 159 by a barrier such as a suspended ceiling 172. The air return plenum 130 is positioned above the air supply plenum 120 and is separated from the air supply plenum 120 by a barrier layer 174. Air return conduits 125 pass through the air supply plenum 120 to provide fluid communication between the conditioned floor space 159 and the return plenum 130. The air conditioner 110 provides conditioned air to the air supply plenum 120 via air supply conduits 115 that pass through the return plenum 130.

The air supply plenum 120 is adapted to provide conditioned air to multiple zones 160A, 160B of the floor space 159. A separate damper or dampers 150A, 150B are provided for each of the different zones 160A, 160B. Zone 160A is cooled by opening damper 150A such that cool air flows from the air supply plenum 120 into the zone 160A. Similarly, to cool the zone 160B, the damper 150B is opened thereby allowing cool air from the air supply plenum 120 to flow into the zone 160B.

While the floor space 159 is shown divided into two regions 160A, 160B, it will be appreciated that in normal applications the given floor space may have a much larger number of zones. For example, in a given floor space of a building, each room of the building may be designated as a different zone thereby allowing the temperature of each room to be independently controlled. Also, while FIG. 1 shows a single floor space, in multi-floor buildings, the return and supply plenums can be positioned between the floors of the building.

In the system of FIG. 1, the air temperature and air pressure within the air supply plenum 120 are maintained at selected constant values. The supply plenum 120 preferably overlies the entire floor space of the building, and provides conditioned air to all of the zones of the floor space. Therefore, separate lines of ductwork are not required to be installed for each zone. This reduction in ductwork assists in reducing original construction costs and also reduces costs associated with reconfiguring a given floor plan.

SUMMARY

One inventive aspect of the present disclosure relates to damper devices adapted for use with air-plenum type air handling systems.

Another inventive aspect of the present disclosure relates to a damper device including a sensing device to determine a position of a damper vane.

A further inventive aspect of the present disclosure relates to a damper device including a position indicator coupled to a damper vane and a sensing device to determine a position, of a damper by sensing the position indicator.

A yet further inventive aspect of the present disclosure relates to methods of initializing and resetting a position of a damper vane of a damper device.

Examples of a variety of inventive aspects in addition to those described above are set forth in the description that follows. It is to be understood that both the foregoing general description and the following detailed description are exemplary and explanatory only and are not restrictive of the broad inventive aspects that underlie the examples disclosed herein.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alternative forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Figure 1:
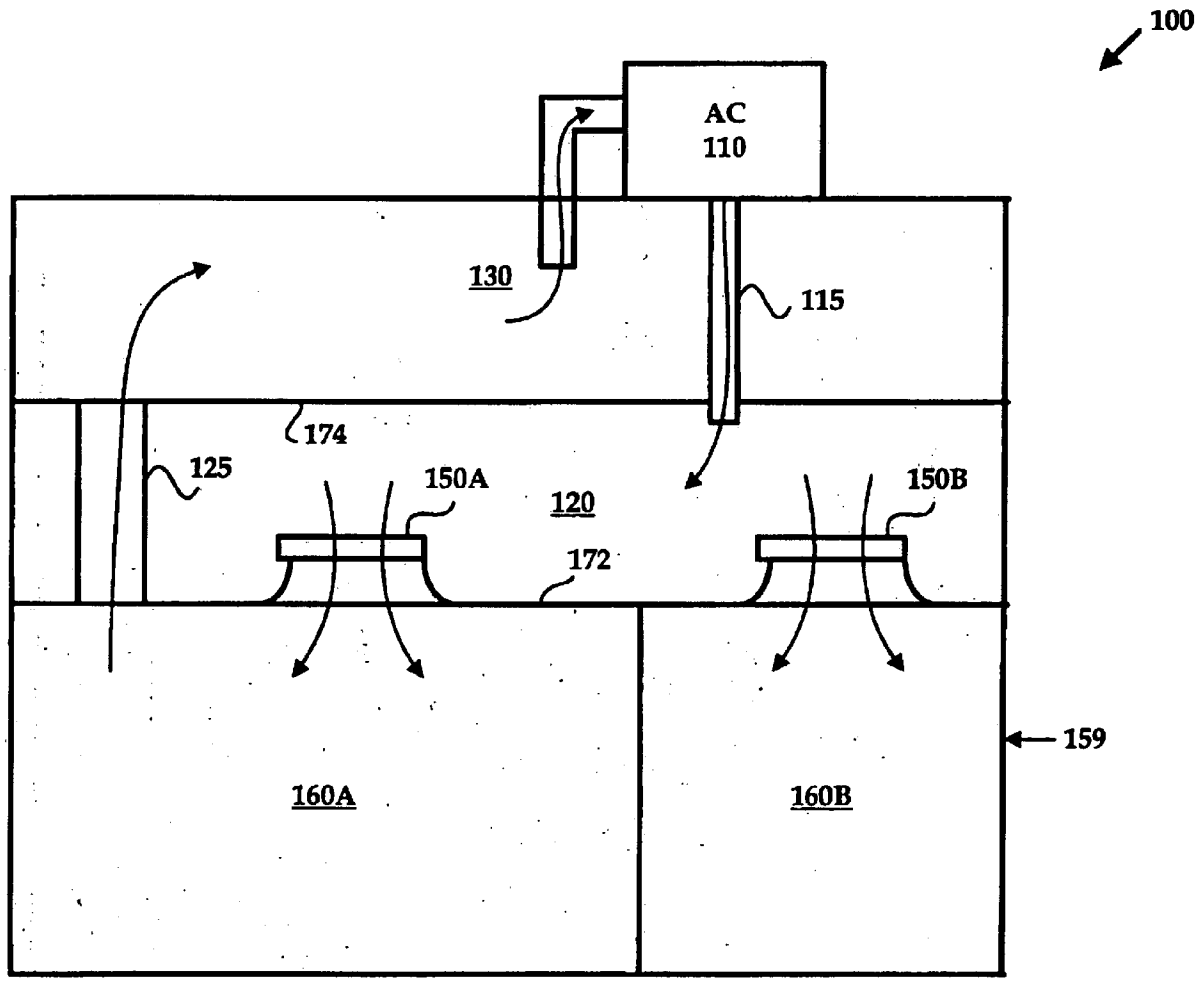
Prior Art Fig.1.
FIG. 1 schematically illustrates a prior art air circulation/conditioning system.

In air handling/circulation systems such as the system 100 of FIG. 1, the dampers 150A, 150B are positioned in close proximity to the underlying floor space 159. Therefore, it is desirable to minimize damper noise that may be distracting to occupants of the underlying space. It is also desirable to accurately position damper vanes to regulate air flow through the damper. Some aspects of the present disclosure relate to features for overcoming problems associated with air-plenum type air circulation systems. In certain embodiments, dampers in accordance with the principles of the present disclosure can be used in an air plenum system having an air supply plenum maintained at a constant temperature in the range of 50 to 60 degrees Fahrenheit, and a constant pressure maintained in the range of 0.025 to 0.1 inches of water. In other embodiments, the pressure in the air supply plenum can be maintained in the range of 0.04 to 0.075 inches of water, or at a pressure of about 0.05 inches of water.

It will be appreciated that the various inventive aspects disclosed herein are not limited to the air-plenum field. Quite to the contrary, the various inventive aspects disclosed herein are applicable to any type of air handling system regardless of whether the system utilizes air plenums, ducts or other air conveying means. Further, although the example air handling system described herein includes air plenums formed above a floor space, the air plenums can also be placed below a floor space if desired.

Certain inventive aspects of the present disclosure relate to an air handling system including a damper device, the damper device having a sensing device to indicate a position of a damper vane. In a preferred embodiment, a position indicator is coupled to the damper vane, and the sensing device senses the position of the position indicator to thereby determine the position of the damper vane.

Figure 2:
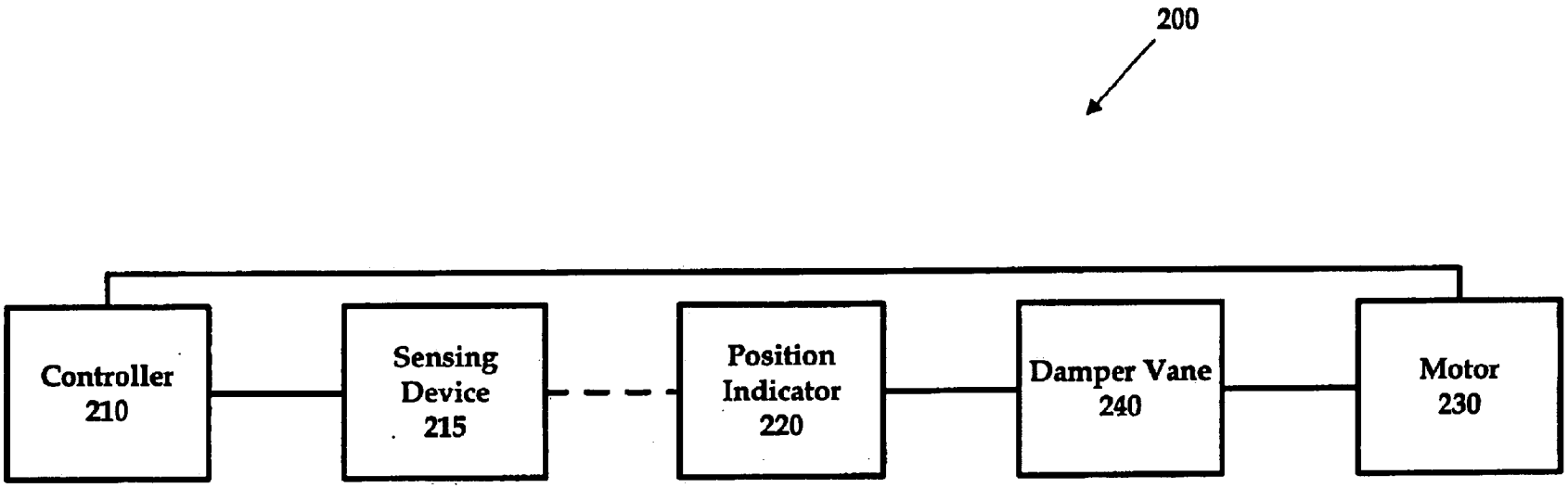
FIG. 2 schematically illustrates an example damper device showing how inventive aspects in accordance with the principles of the present disclosure may be practiced.

Referring now to FIG. 2, an example damper device 200 for use in an air handling system such as the system of FIG. 1 is schematically illustrated. The damper 200 includes a motor 230 that is coupled to a damper vane 240 to move the vane, for example, between an open and closed position.

The damper vane 240 rotates in concert with a position indicator 220. The position indicator 220 can be connected to the vane 240, or as noted in more detail below the indicator 220 can be coupled to a shaft of the motor 230 to rotate as the vane is rotated. As noted below, in preferred embodiments the indicator 230 is a magnet, although other types of indicators can also be used. In some embodiments, the indicator can be eliminated depending on the type of sensing device used. For example, in alternative embodiments the indicator can be the damper vane itself.

The damper 200 also includes a sensing device 215 coupled to a controller 210. The sensing device 215 is configured to sense when the position indicator 220 comes into close proximity to the sensing device. When the sensing device 215 senses the indicator 220, the sensing device sends a signal to the controller 210, which in turn controls a position of the motor 230. As noted below, the sensing device 215 is preferably a Hall Effect sensor. However, the sensing device can also be an optical sensor, a proximity sensor, or any number of different types of sensors.

Preferably, the position indicator 220 and the sensing device 215 are positioned such that the position indicator comes into close proximity with the sensing device at a given rotational position for the damper vane 240. For example, the position indicator and sensing device can be positioned so that a "home" position is indicated when the sensing device detects the indicator, the home position preferably being the fully closed position for the damper. Other positions can also be indicated, as desired.

Figure 3A:
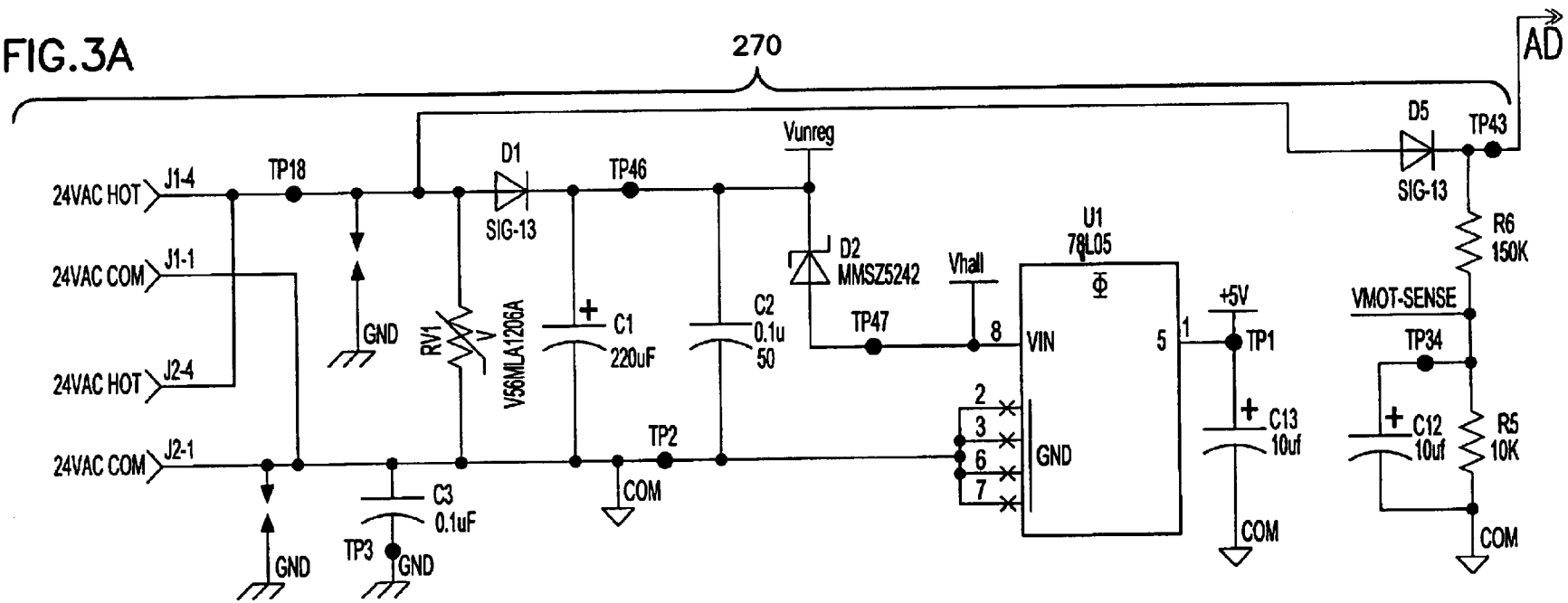
FIG. 3A is a portion of a schematic showing example circuitry for a damper illustrating how inventive aspects in accordance with the principles of the present disclosure may be practiced.
Figure 3B:
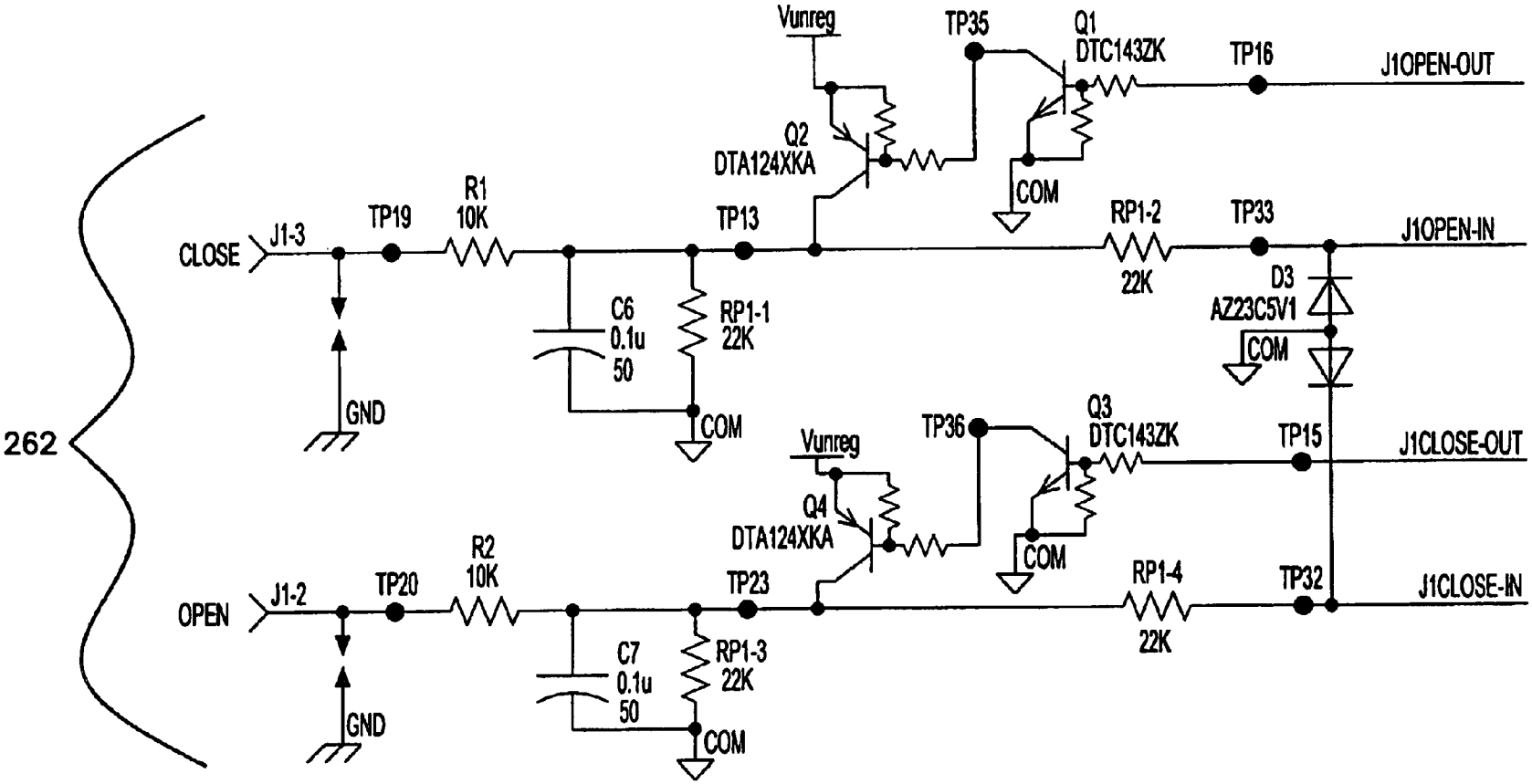
FIG. 3B is another portion of the schematic showing example circuitry for a damper illustrating how inventive aspects in accordance with the principles of the present disclosure may be practiced.
Figure 3C:
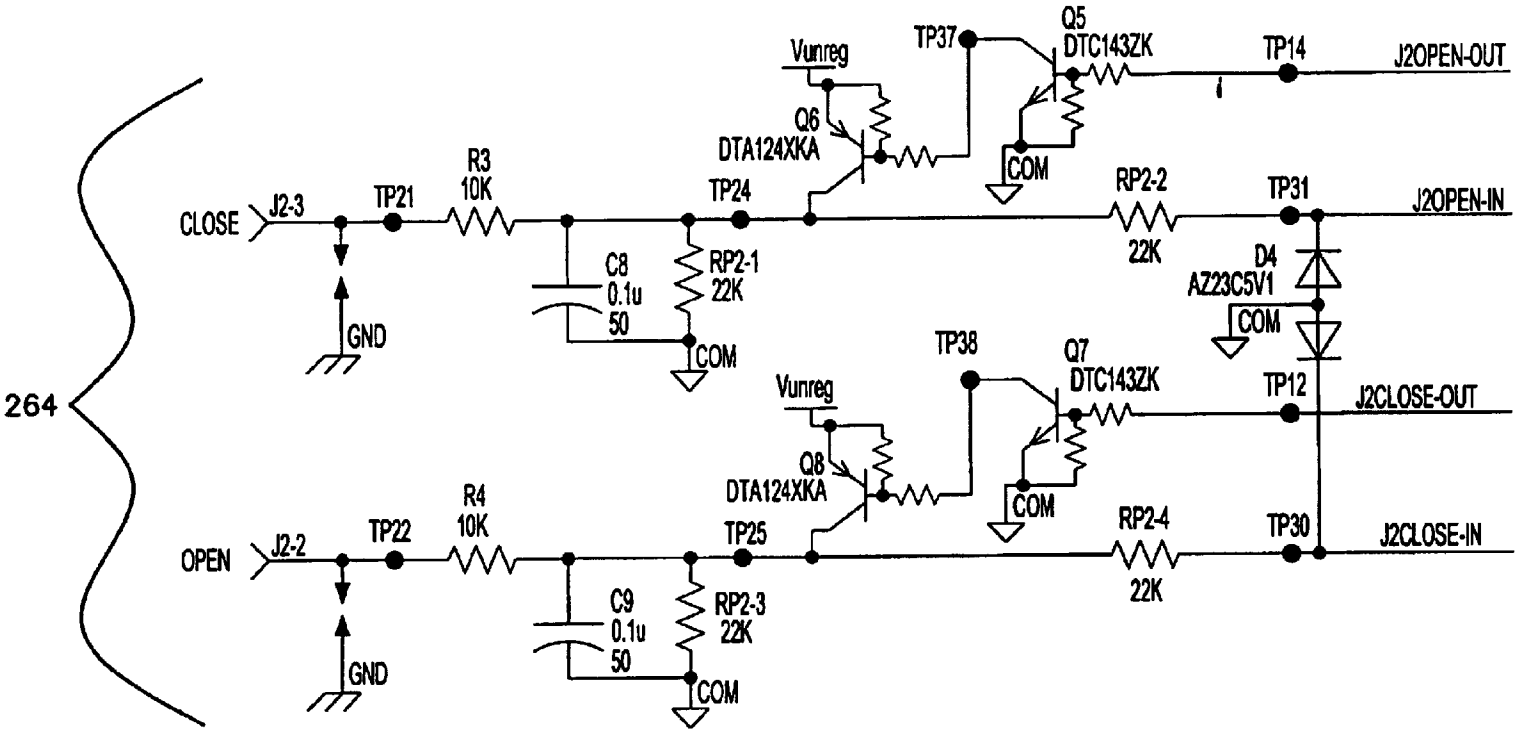
FIG. 3C is another portion of the schematic showing example circuitry for a damper illustrating how inventive aspects in accordance with the principles of the present disclosure may be practiced.
Figure 3D:
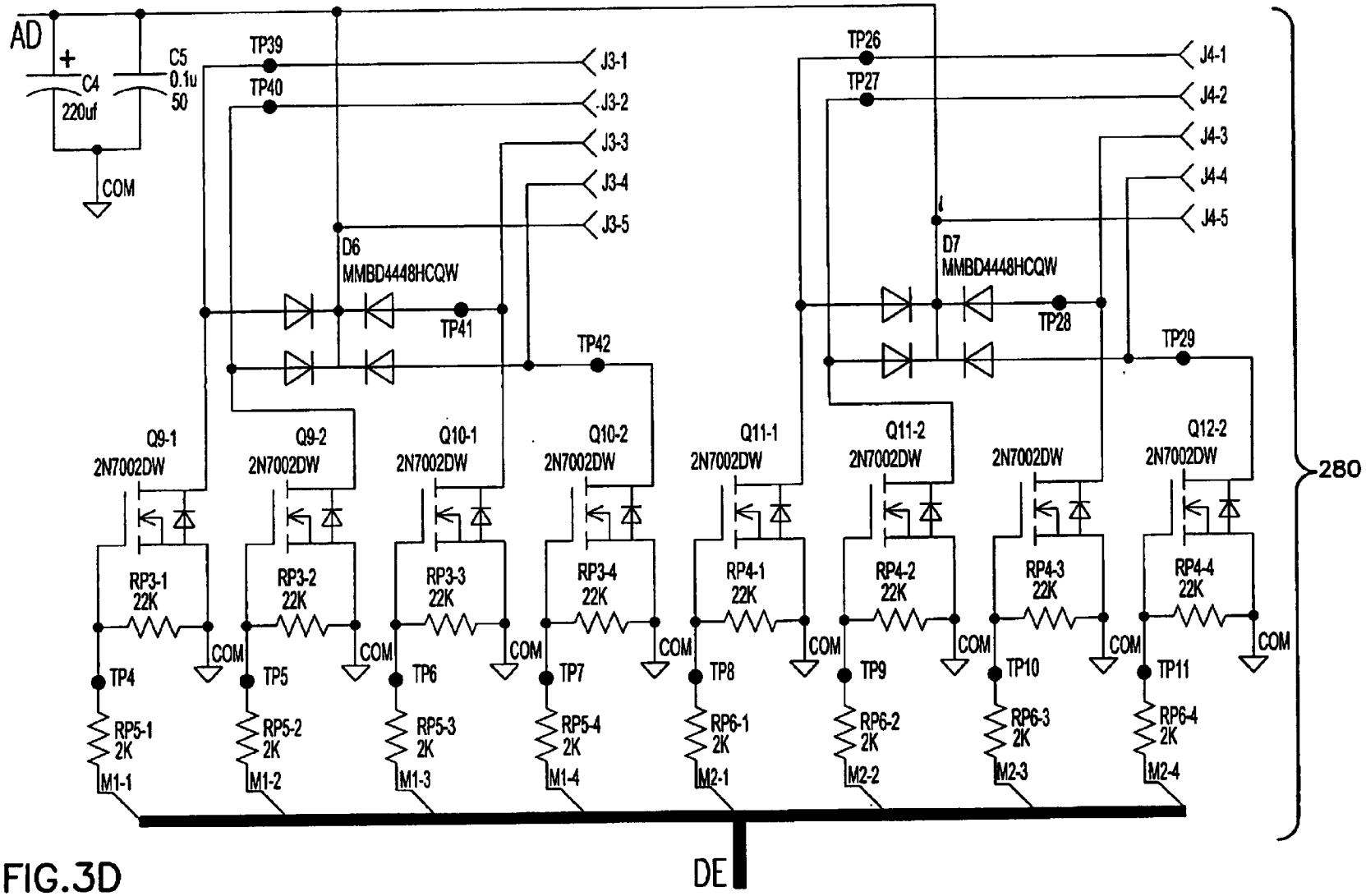
FIG. 3D is another portion of the schematic showing example circuitry for a damper illustrating how inventive aspects in accordance with the principles of the present disclosure may be practiced.
Figure 3E:
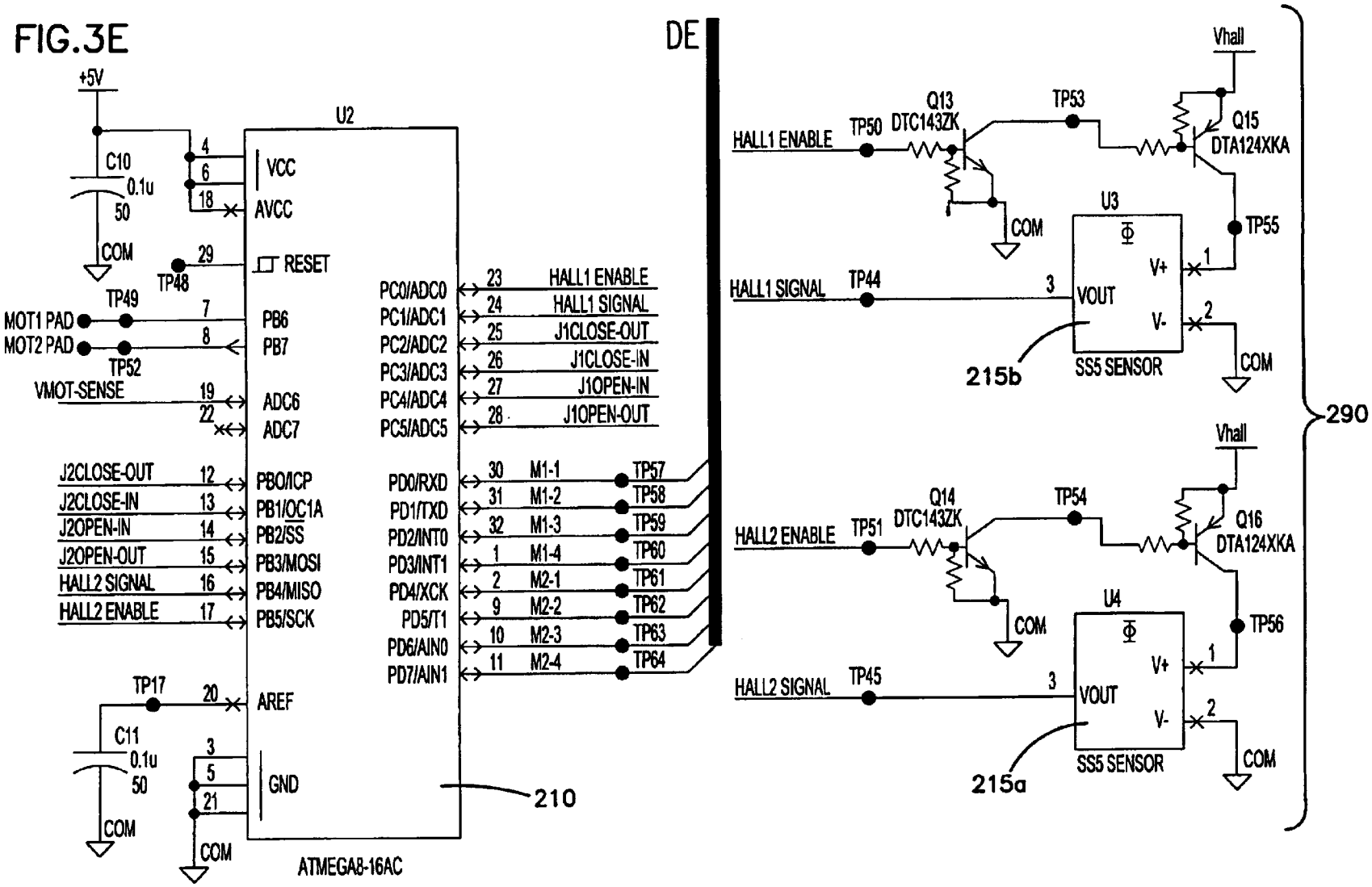
FIG. 3E is another portion of the schematic showing example circuitry for a damper illustrating how inventive aspects in accordance with the principles of the present disclosure may be practiced.

Referring now to FIGS. 3A–E, an example schematic diagram of the circuitry of the damper 200 is shown. Generally included are connection stages 262, 264 that provide input/output ports, a power module 270 for providing power to the damper 200, and a commutation module 280 configured to commutate the motor of the damper. Also included is a position correction module 290 with sensing devices 215*a* and 215*b*. In the example illustrated in FIGS. 3A–E, two sensing devices are provided because the damper includes two damper vanes. More or fewer sensing devices can be provided as desired. The example sensing devices 215*a* and 215*b* illustrated in FIG. 3E are Hall Effect sensors that are coupled to the controller 210, the sensing devices each providing a signal to the controller 210 upon detection of a position indicator.

Figure 4:
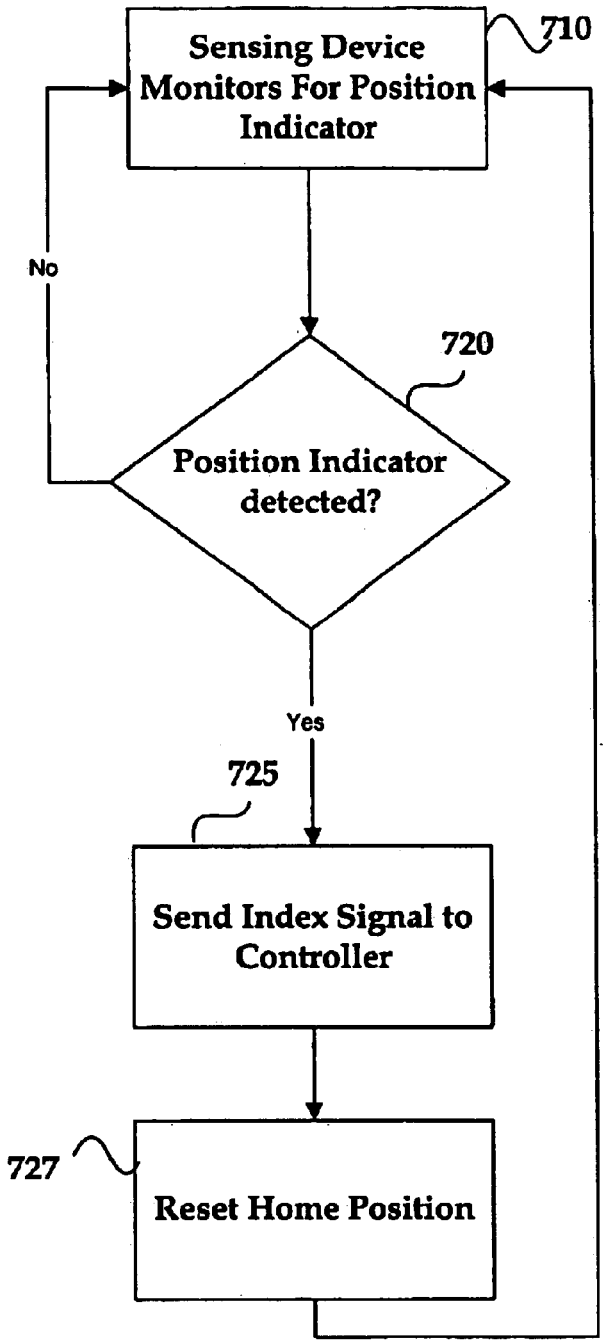
FIG. 4 is an example flow diagram illustrating control of a damper device in accordance with how principles of the present disclosure may be practiced.

Referring now to FIG. 4, an example method of positioning the damper vane of the damper is provided. In operation 710, the sensing device monitors for the position indicator. In operation 720, the sensing device determines whether or not the position indicator has been detected. If not, the sensing device continues to monitor as control is passed back to operation 710.

If the position indicator is detected, control is passed to operation 725, in which an index signal indicating detection of the position indicator is sent to the controller. Next, in operation 727 the controller resets the home position for the damper vane. In this manner, the position of the damper vane can be optimized.

Figure 5:
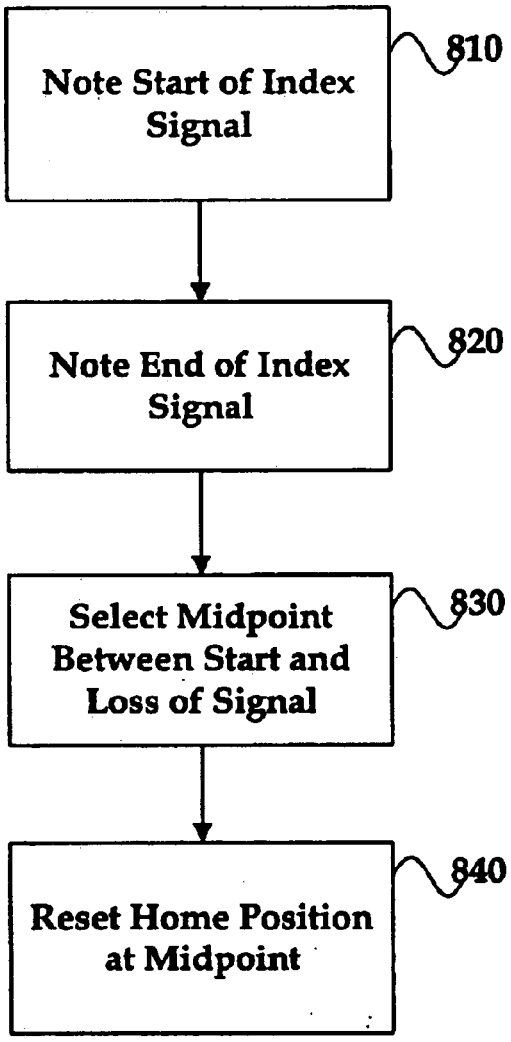
FIG. 5 is another example flow diagram illustrating control of a damper device in accordance with how principles of the present disclosure may be practiced.

Referring now to FIG. 5, in a preferred embodiment a subroutine can be performed to further optimize the home position of the damper. In operation 810, the beginning of the index signal signifying detection of the position indicator by the sensing device is noted by the controller as the vane is moved. Next, in operation 820, the end of the index signal is noted by the controller as the vane continues to move. In operation 830, the midpoint between the start and end of the signal is calculated, and in operation 840 the home position is reset at the midpoint. If the subroutine in FIG. 5 is performed, it is preferable to continue driving damper vane until the index signal is lost, and then to return the damper vane to the home position once the midpoint is calculated.

In a preferred embodiment, home position is reset upon initialization of the damper device, as well as upon each complete revolution of the damper vane. In alternative embodiments, home position can be set more or less frequently as desired. For example, it is possible to reset home position upon each movement of the damper vane, if multiple sensing devices are used.

A home position can be set for each desired position of the damper vane, or a home position can be set for one position, such as the closed position. In a preferred embodiment including a single home position at the closed position, a stepper motor (described further below) is used so that the damper vane can be moved from the closed position to the open position by causing the motor to move the shaft a given number of steps.

For example, a stepper motor typically includes stationary windings and poles formed on a rotor, and a shaft that can be made to rotate in discrete steps by alternating the polarity of voltage applied across the windings in the correct sequence. The stepper motor preferably includes at least 12 steps per revolution, more preferably at least 24 steps, and even more preferably at least 48 steps. The stepper can move a vane from the home position to an open position by moving the vane a given number of steps.

In an alternative embodiment without a stepper motor, the damper vane can be moved to the open position using a timing mechanism that monitors the time necessary for the vane to move from the closed position to the open position.

It can be advantageous to use the sensing device and position indicator as described herein so that the damper vanes can be accurately positioned. Such a system can be especially preferable in dampers including vanes that rotate completely rather than back and forth between open and close stops. Therefore, for example, if a damper vane becomes misaligned during a complete rotation between open and closed positions as described below, the home position can be reset upon detection of the position indicator by the sensing device. For example, should something obstruct a vane while it is moved from a closed to an open position, the vane may become misaligned. This misalignment will be maintained, since the vane is simply moved a number of steps upon each open and close movement, until such time as the home position is reset, thereby realigning the vane. In this manner, the positioning of the damper vanes can be optimized.

Figure 6:
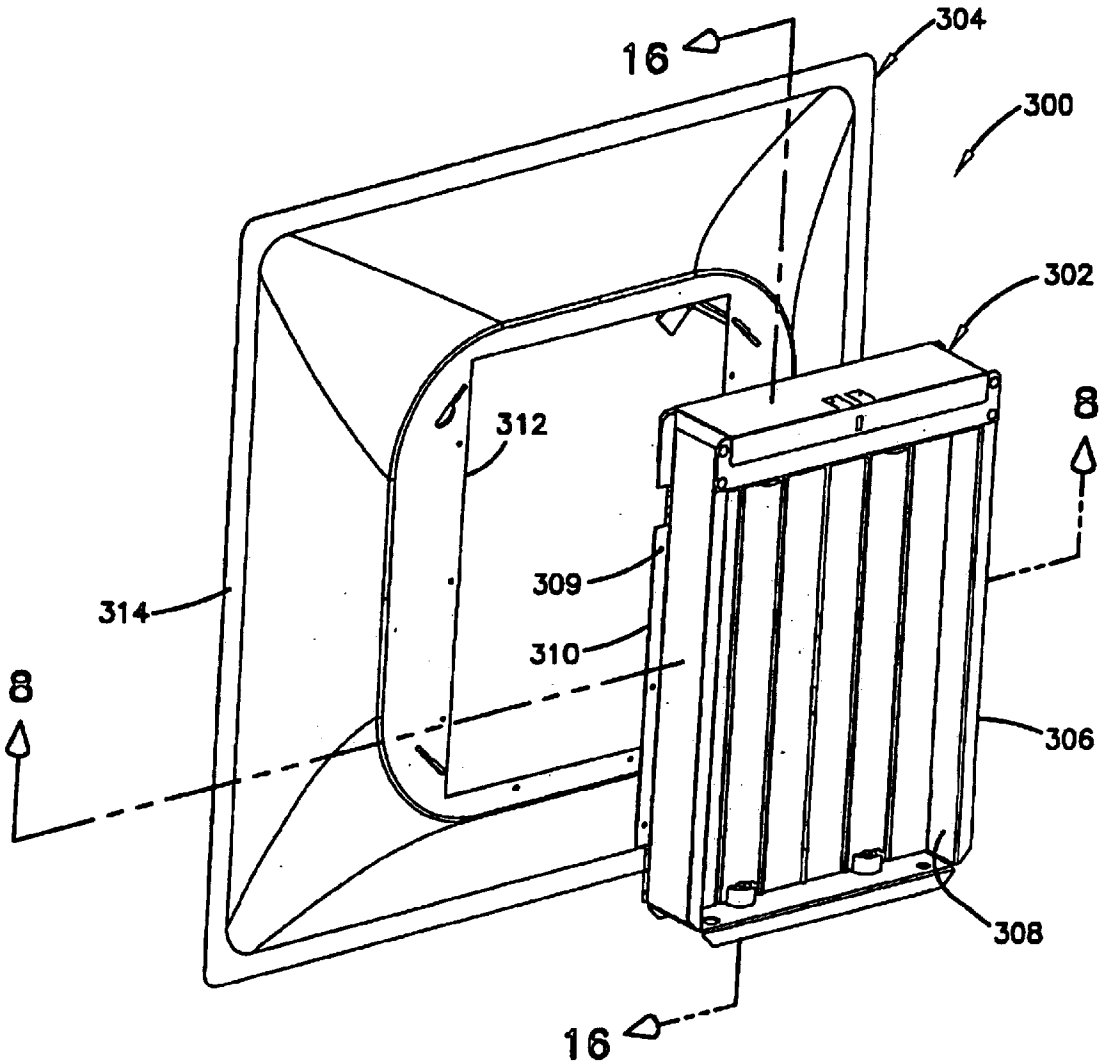
FIG. 6 is a perspective view of another air-handling device having features that are examples of how inventive aspects in accordance with the principles of the present disclosure may be practiced.

FIG. 6 illustrates an air handling device 300 having features that are examples of inventive aspects in accordance with the principles of the present disclosure. The air-handling device 300 includes a damper unit 302 and an air diffuser 304. The damper unit 302 includes a frame 306 defining an airflow opening 308. The frame 306 of the damper unit 302 can be connected to the air diffuser 304 by conventional techniques such as fasteners (e.g., screws, bolts, clips or rivets), welding or a snap-fit connection. As shown in FIG. 6, frame 306 is connected to the air diffuser 304 by fasteners that extend through openings 309 defined by flanges 310 of the frame 306. When the damper unit 302 is secured to the diffuser 304, the airflow opening 308 of the frame 306 aligns with a corresponding opening 312 defined by the air diffuser 304.

Figure 7:
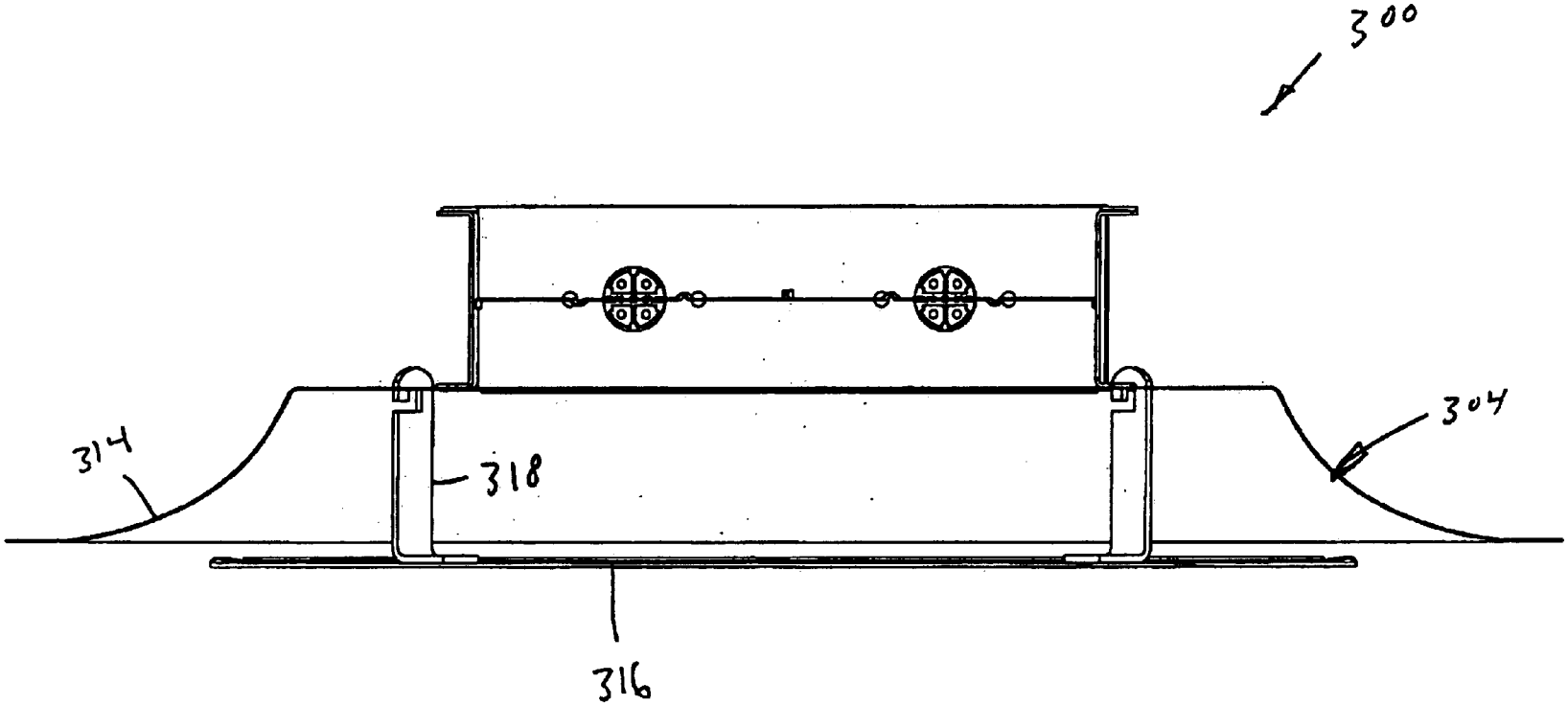
FIG. 7 is a cross-sectional view taken along section line 8—8 of FIG. 6.
Figure 9:
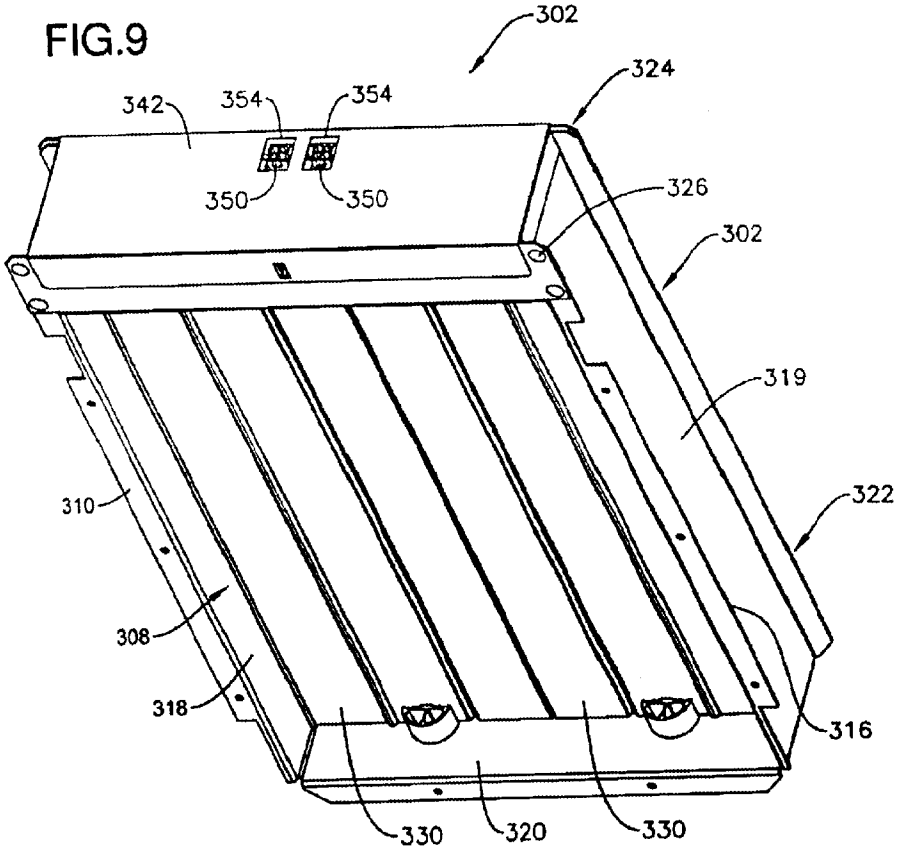
FIG. 9 is another perspective view of the damper unit of FIG. 8.
Figure 8:
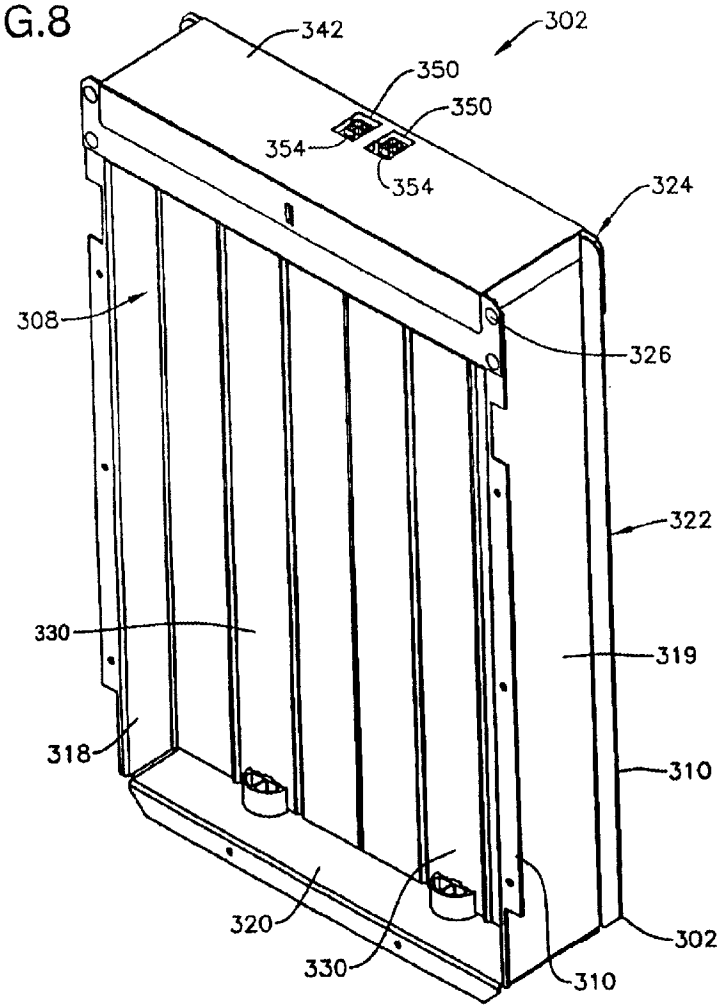
FIG. 8 is a perspective view of a damper unit that is part of the air-handling device of FIG. 6.

As best shown in FIG. 7, the air diffuser 304 includes an outer skirt 314 that tapers outwardly from the opening 312. The air diffuser 304 also includes an inner diffuser structure 316 connected to the outer skirt 314 by hooks 318. In use, the damper unit 302 functions selectively open and close air flow to the air diffuser 304, and the air diffuser functions to diffuse or spread airflow provided to the diffuser through the damper unit 302.

Referring now to FIGS. 8–13, the damper unit 302 is shown in isolation from the air diffuser 304. The frame 306 of the damper unit 302 has a generally rectangular configuration including two opposing major side walls 318, 319 interconnected by two opposing, minor side walls 320, 321. Inner surfaces of the side walls 318–321 define the airflow opening 308 of the damper unit 302.

It will be appreciated that the side walls 318–321 can be manufactured from any number of different types of materials such as metal, plastic or other materials. In the depicted embodiment, side walls 318, 319 and 320 are defined by a first component 322 (e.g., a first piece of bent sheet metal), and the side wall 321 is defined by a second component 324 (e.g., a second piece of bent sheet metal). The second component 322 is fastened to the major side walls 318, 319 by fastening structures such as rivets 326. To increase the rigidity of the frame 306, flanges 310 are provided about the outer perimeter of the frame 306.

Figure 11:
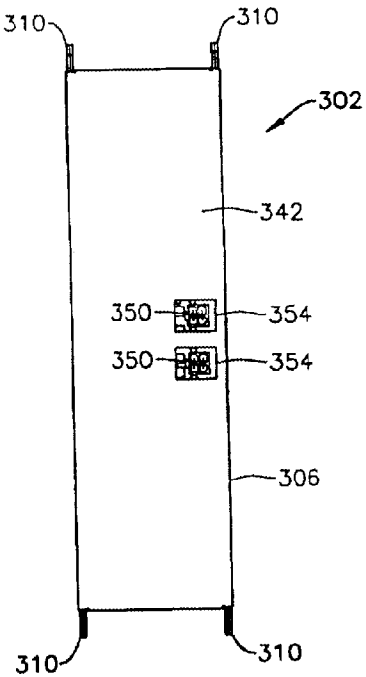
FIG. 11 is a right end view of the damper unit of FIG. 10.
Figure 10:
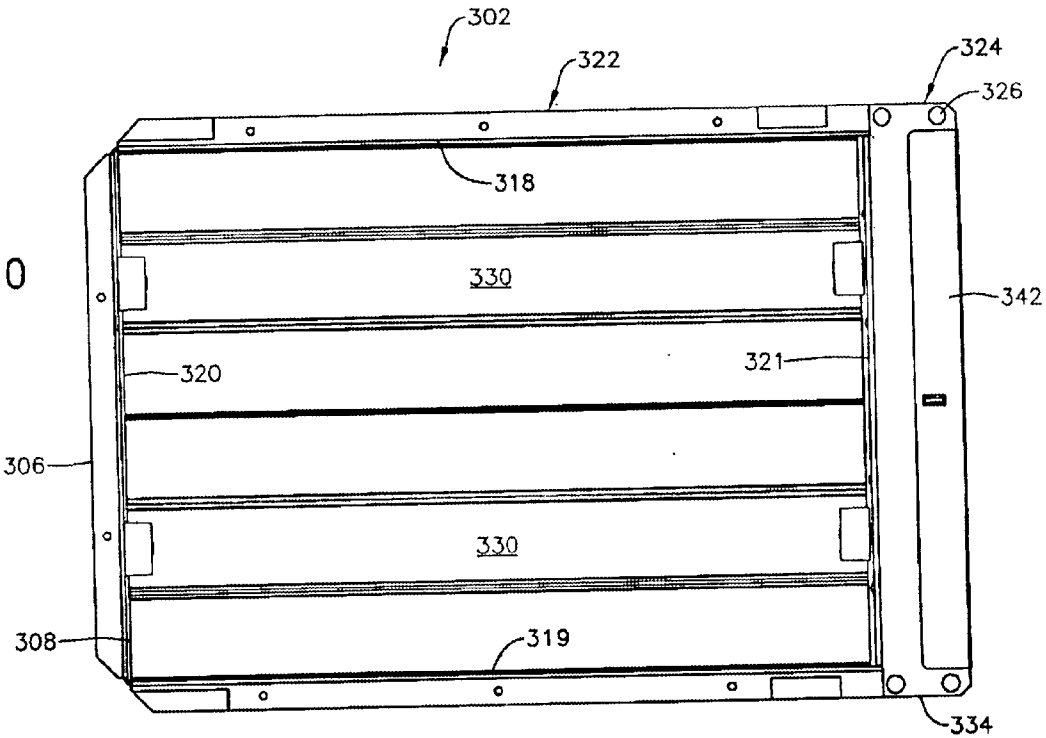
FIG. 10 is a top plan view of the damper unit of FIG. 8.
Figure 12:
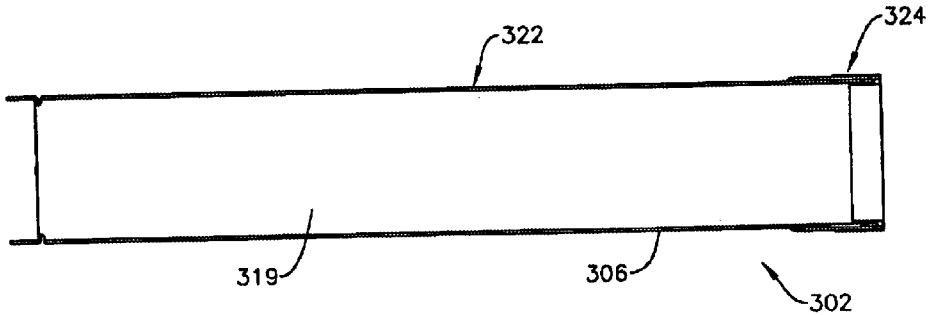
FIG. 12 is a front, elevational view of the damper unit of FIG. 10.

The damper unit 302 is equipped with two damper vanes 330 for selectively opening and closing the airflow opening 308. The damper vanes 330 are rotated relative to the frame 306 between open and closed positions by drive motors 332 (see FIG. 9). The drive motors 332 are positioned within a housing 334 located at one end of the frame 306. The housing 334 is defined primarily by the second component 324. For example, as shown in FIG. 11, the component 324 defines an upright wall 336 corresponding to the minor side wall 321 of the frame 306. The second component 324 also includes a top wall 338 and a bottom wall 340. The housing 334 further includes a removable cover 342 that fastens to the top and bottom walls 338, 340 at a location opposite from the upright wall 336. Portions of the major side walls 318, 319 of the frame 306 extend past the upright wall 336 to enclose opposite ends of the housing 334.

Figure 13:
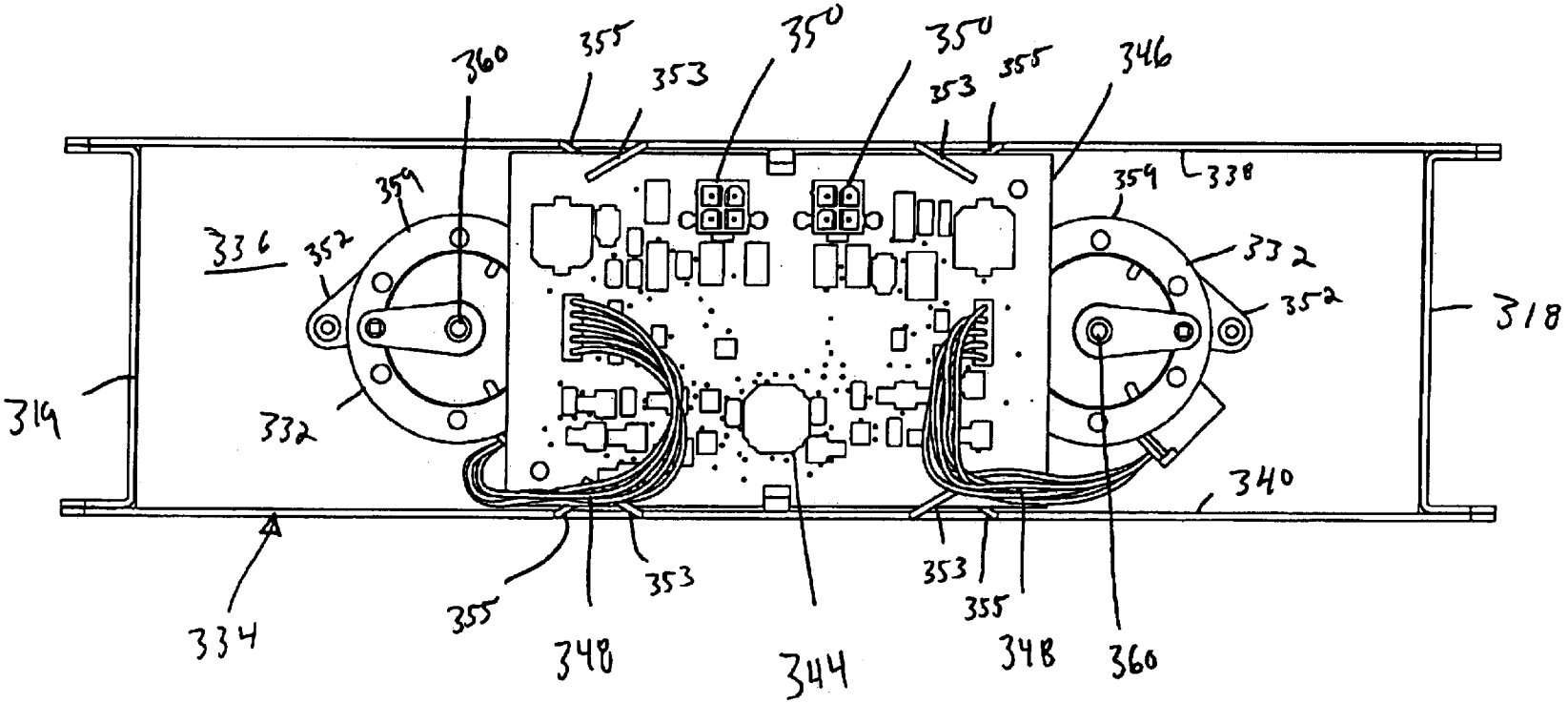
FIG. 13 is a right end view of the damper unit of FIG. 10 with an end cover removed to show an interior of a motor housing.

Referring to FIG. 13, two drive motors 332 are positioned within the housing 334. The motors 332 are controlled by a control device including a microcontroller 344 mounted on a printed circuit board 346. Wires 348 electrically connect the control device to the motors 332. The control device is also equipped with input/output ports 350 mounted on the circuit board 346. The cover 342 can include openings 354 (see FIGS. 8 and 9) for providing ready access to the input/output ports 350 even when the cover is secured to the top and bottom walls 338, 340 of the housing 334. As described in U.S. application Ser. No. 10/632,669, entitled "Bi-Directional Connections for Daisy-Chained Dampers" and filed on a date concurrent herewith, the ports 350 can be used to coupled the control device to a main controller, and/or to daisy chain multiple damper units together. The above-identified application is hereby incorporated by reference in its entirety.

Still referring to FIG. 13, the drive motors 332 are preferably mounted to the upright wall 336. For example, the motors 334 can include casings 359 having mounting flanges 352 for securing the motors 332 directly to the upright wall 336 by conventional fasteners such as rivets, clips, screws, bolts or other fastening techniques. The printed circuit board 346 and wires 348 are preferably mounted within the housing 334. The top and bottom walls 338, 340 of the housing 334 can include sets of inwardly bent tabs 353, 355 (see FIG. 14) for mounting and securing the circuit board 346 within the housing 334. Edges of the circuit board 346 are adapted to be captured between the sets of tabs 354, 355.

While the drive motors 332 can be any type of drive mechanism, as noted above preferred drive mechanisms for rotating the vanes 330 include stepper motors. The drive motors 332 are shown including drive shafts 360 driven by drive mechanisms housed within the casings 359 of the motor 332.

In preferred embodiments, the stepper motors are used to modulate the amount of time that the damper vanes are open for each duty cycle. It is therefore preferable to configure the motor to open and close the vanes in a short amount of time. In one example, each vane can be opened or closed in less than 10 seconds, more preferably less than 5 seconds, and even more preferably less than 2 seconds. In one embodiment, the motors 332 are configured to open or close each vane in about 1 second.

In a preferred embodiment, the motors 332 are further configured as described in U.S. application Ser. No. 10/632,669, entitled "Damper Including a Stepper Motor" and filed on a date concurrent herewith. The above-identified application is hereby incorporated by reference in its entirety.

Figure 15:
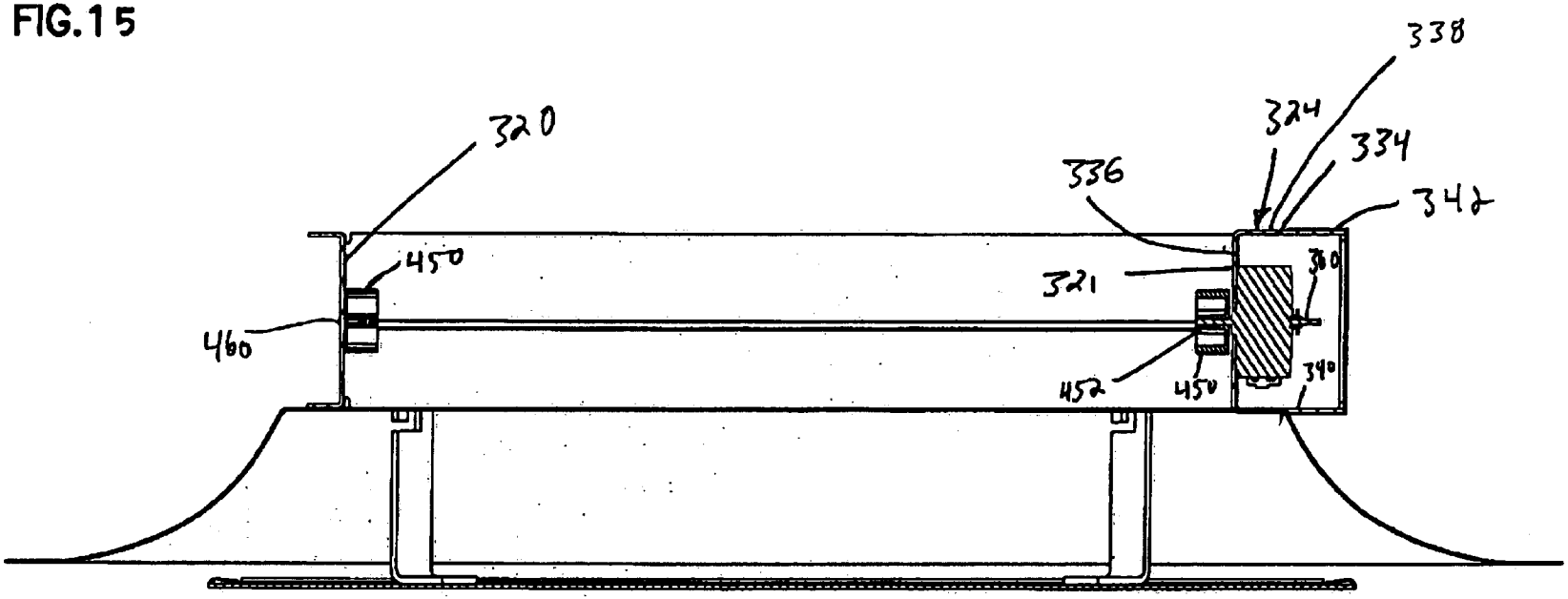
FIG. 15 is a cross-sectional view taken along section line 16—16 of FIG. 7.
Figure 15A:
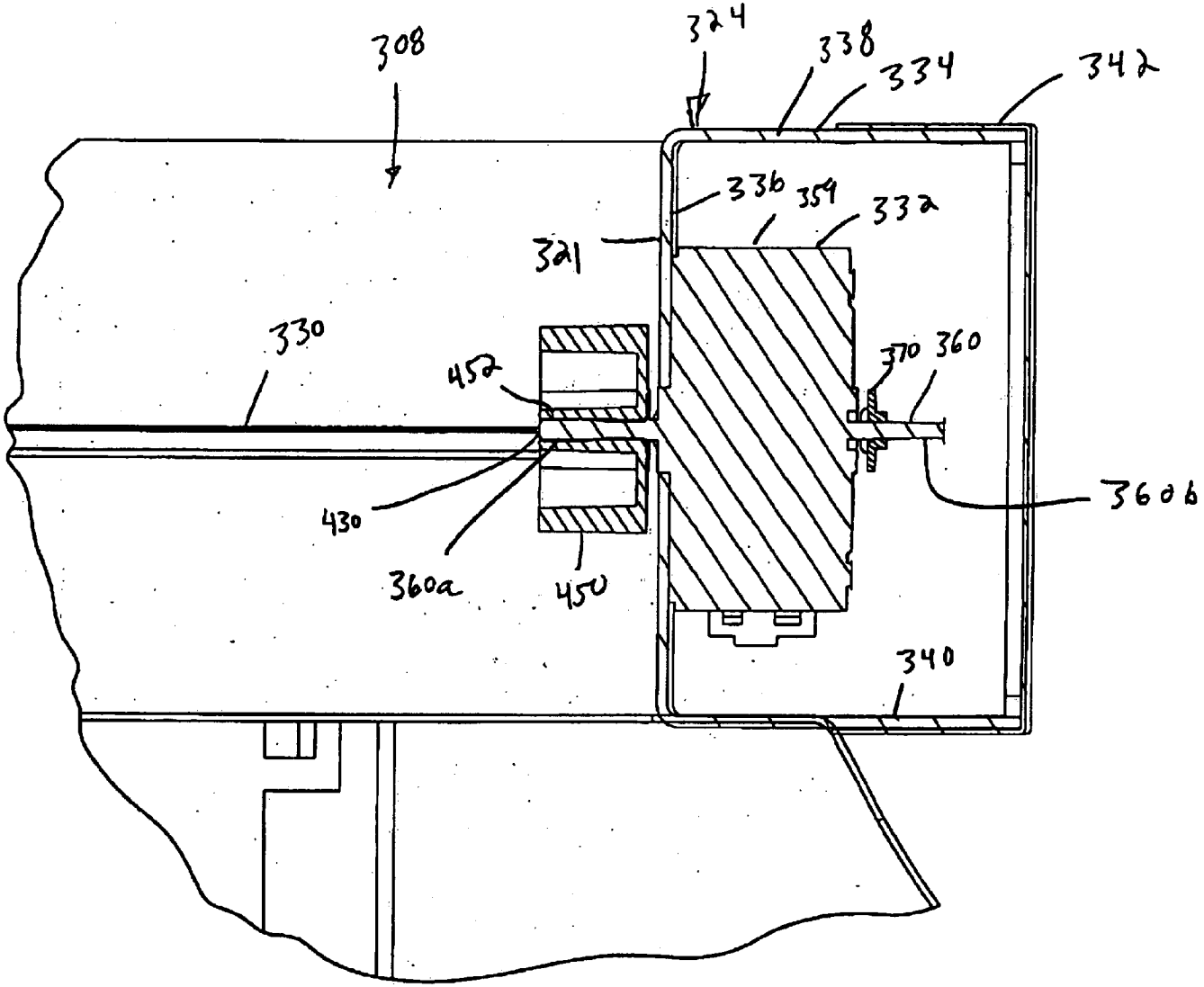
FIG. 15A is an enlarged, detailed view of a portion of FIG. 15.

Referring to FIGS. 15 and 15A, a cross-sectional view through one of the motors 332 is provided. As is apparent from FIG. 15, the motor 332 is mounted directly to the upright wall 336. As indicated previously, the upright wall 336 corresponds to the minor side wall 321 having an inner surface that defines one of the sides of the airflow opening-308. The drive shaft 360 of the motor 332 includes a first end 360A that extends through the upright wall 336 and projects into the airflow opening 308. For example, the first end 360*a* is shown projecting through an opening 362 in the upright wall 336 so as to extend into the airflow opening 308. The first end 360*a* of the shaft 360 is preferably directly coupled to one of the damper vanes 330.

Figure 18:
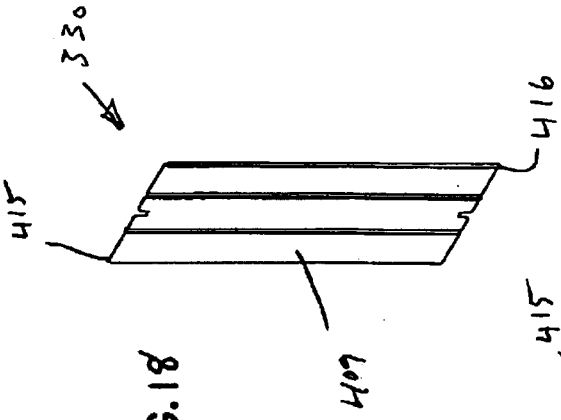
FIG. 18 is a perspective view of one of the damper vanes of the damper unit of FIG. 8.
Figure 20:
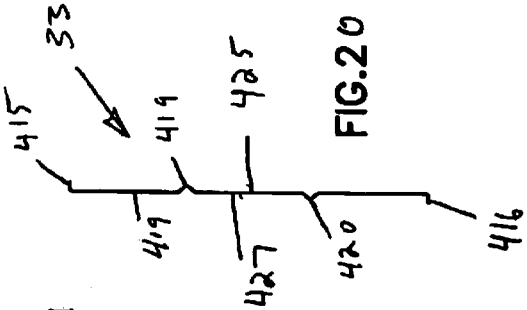
FIG. 20 is a right end view of the damper vane of FIG. 19.
Figure 19:
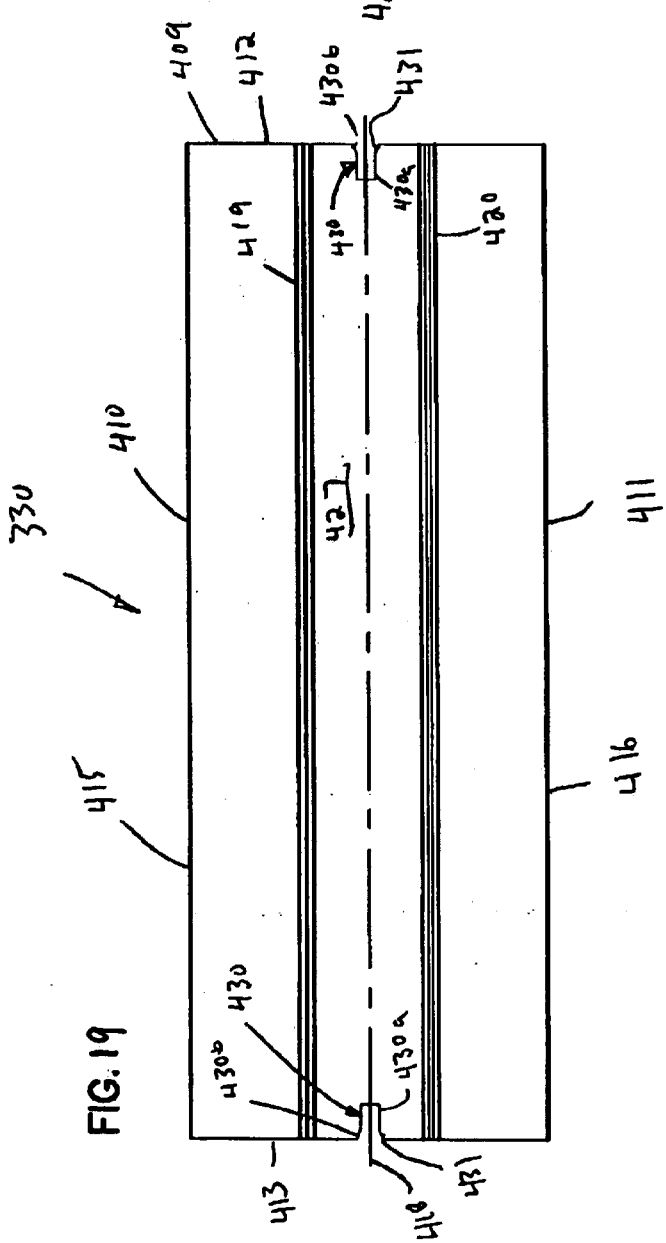
FIG. 19 is a plan view of the damper vane of FIG. 18.
Figure 22:
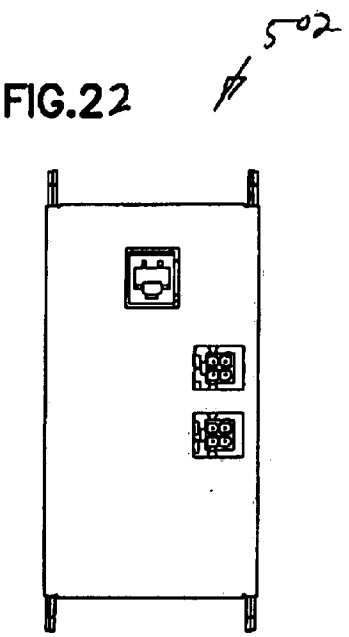
FIG. 22 is a right end view of the damper unit of FIG. 21.
Figure 21:
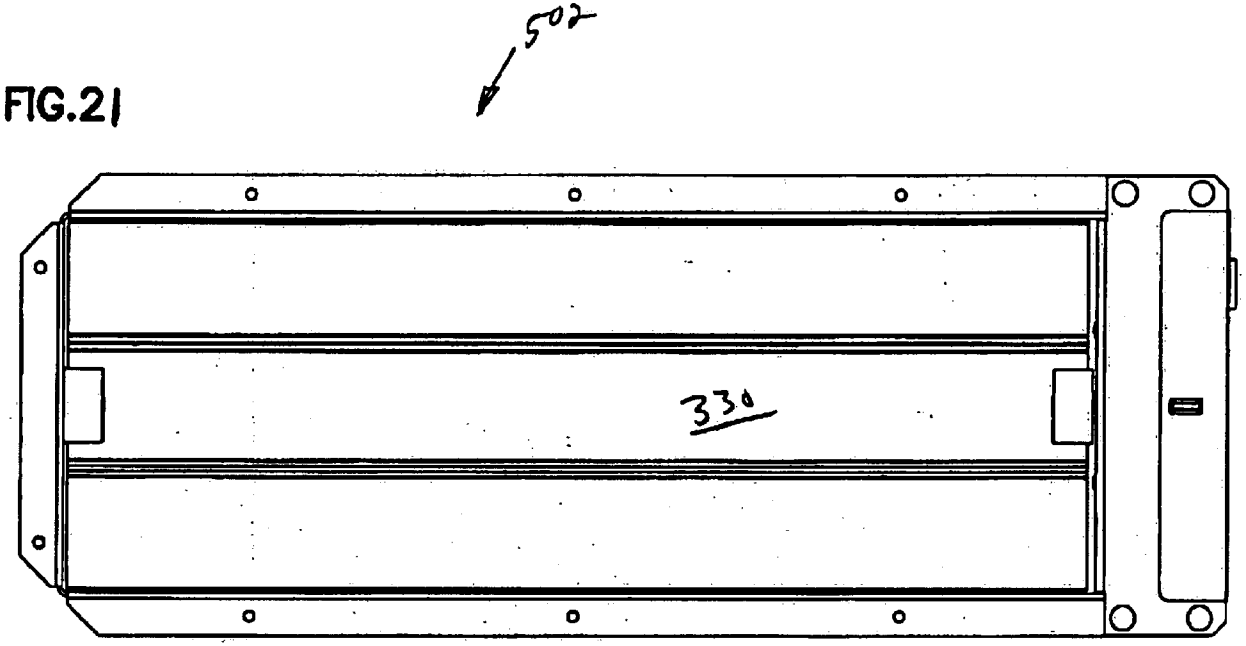
FIG. 21 is a plan view of an alternative damper unit in accordance with the principles of the present disclosure.
Figure 24:
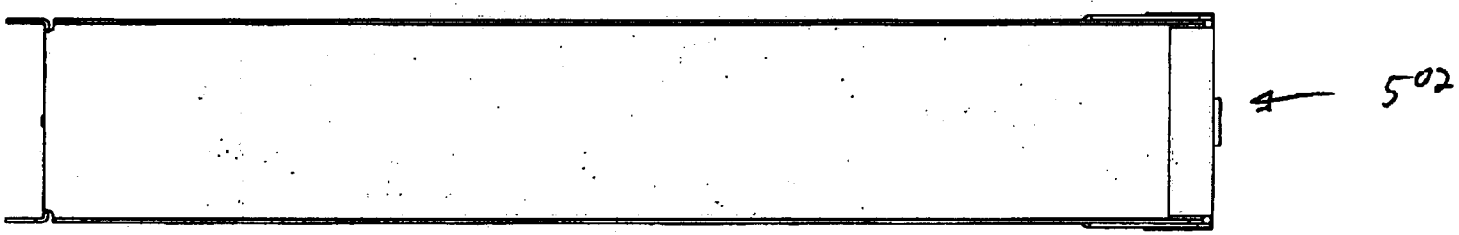
FIG. 24 is a front elevational view of the damper unit of FIG. 21.
Figure 23:
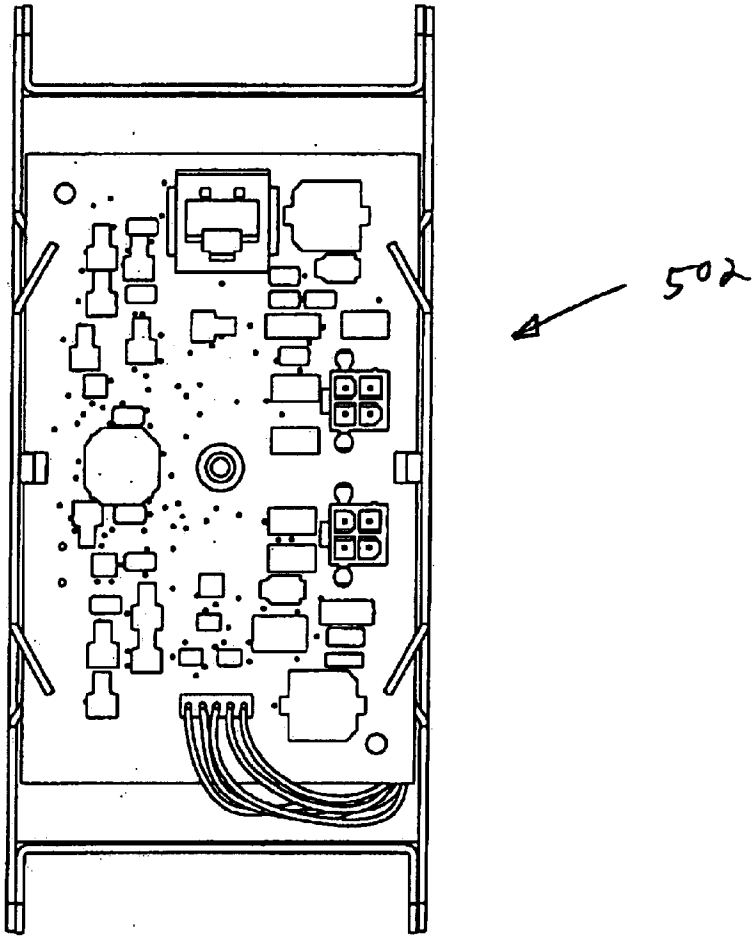
FIG. 23 is a right end view of the damper unit of FIG. 21 with an end cover removed to show the interior of a motor housing.

Referring to FIGS. 18–20, one of the damper vanes 330 is shown in isolation from the remainder of the damper unit. The depicted damper vane 330 has a generally rectangular shape having oppositely positioned major edges 410, 411 and oppositely positioned minor edges 412, 413. Similar to the vane embodiments described above, the vane 330 includes aerodynamic features for using air flow to generate supplemental torque for rotating the vane. For example, a first lip 415 is shown positioned at the major edge 410, and a second lip 416 is shown positioned at the major edge 411. The lips 415, 416 are shown having lengths that are generally parallel to an axis of rotation 418 of the vane 330. As depicted in FIGS. 18–20, the lips 415, 416 extend along the entire lengths of the major edges 410, 411. However, in alternative embodiments, the lips 415, 416 may extend along only portions of the edges 410, 411, or be arranged in other configurations.

As best shown in FIG. 20, the lips 415, 416 project outwardly from opposite major sides 425, 427 (i.e., major faces) of a main body 409 of the vane 330. The vane 330 also includes integral ribs 419, 420 for reinforcing the main body 409. Rib 419 is positioned between the first lip 415 and the axis of rotation 418 of the vane 330, and projects outwardly from the first major side 425 of the main body 409. Rib 420 is positioned between the second lip 416 and the axis of rotation 418, and projects outwardly from the second major side 427 of the main body 409. As depicted in FIG. 20, the ribs 419, 420 comprise bends (e.g., 90 degree bends) provided in the main body 409.

Referring to FIG. 19, notches 430 are provided at the minor edges 412, 413 of the vanes 330. The notches 430 are positioned at the axes of rotation 418 of the vanes 330 and are provided to facilitate coupling the vanes 330 to drive mechanisms. Each of the notches 430 includes a generally rectangular portion 430*a* and tapered portion 430*b*. The notches 430 are defined by notch edges 431.

It is preferred for the drive mechanism rotating the vanes 330 to rotate one of the vanes only in the clockwise direction. Thus, the vane is rotated in the clockwise direction when moved from the closed position to the open position, and when the vane is moved from the open position back to the closed position. Thus, the inner and outer ends of the vane are constantly alternating. It will be appreciated that the other vane 330 operates in a similar manner. For example, the drive mechanism drives the other vane in the counter-clockwise direction when moving the vane from the closed position to the open position, and when moving the vane from the open position to the closed position.

In a preferred embodiment, the vanes 330 are further configured as described in U.S. application Ser. No. 10/632, 513, entitled "Damper Vane" and filed on a date concurrent herewith. The above-identified application is hereby incorporated by reference in its entirety.

Figure 16:
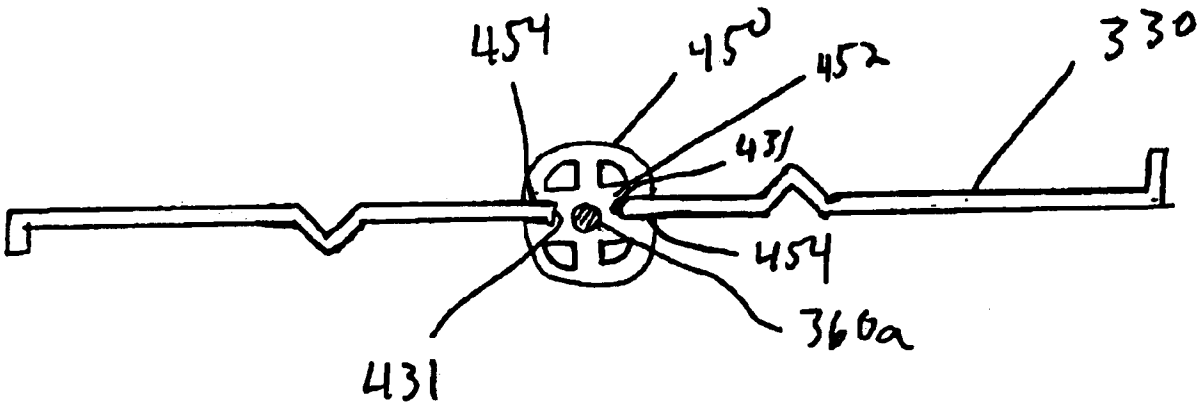
FIG. 16 is a cross-sectional view through one of the damper vanes of the damper unit of FIG. 8.

Referring to FIGS. 15, 15A and 16, hubs 450 are used to provide direct connections between the first ends 460*a* of the shafts 460 and the minor edges 412 of the damper vanes 330. The hubs 450 are preferably made of a plastic material, but could also be made of other materials. The hubs 450 include center sleeves 452 in which the first ends 460A of the shafts 460 are fixedly mounted such that the hubs 450 and the shafts 460 are not free to rotate relative to one another. For example, the first ends 460*a* of the shafts 460 can be pressed within the sleeves 452 with splines of the shafts imbedded within the sleeves 452 to prevent relative rotation therein-between.

Referring still to FIG. 15A, the sleeves 452 of the hubs 450 fit within the notches 430 of the vane 330. Also, as shown in FIG. 16, the notch edges 431 fit within slots 454 defined by the hubs 450 to provide a connection between the hub 450 and the vane 330.

Hubs 450 are also used to connect the minor edges 413 of each of the vanes 330 to the frame 306. For example, as shown in FIG. 15, the minor edges 413 of the vanes 330 can be rotatably coupled to the minor side wall 320 of the frame 306 by hubs 450 mounted on pins 460. The pins 460 are preferably pressed through openings in the minor side wall 320. The pins 460 are preferably mounted so as to not rotate relative to the minor side wall 320. The pins 460 fit within the sleeves 452 of the hub 450. The pins 460 are preferably smaller than the openings in the sleeve 452 such that the hubs 450 are capable of rotating freely relative to the pins 460. The hubs 4450 engage the minor edges 413 of the vanes 330 in the same manner described above with respect to the minor edges 412 of the vanes 330.

To assembly the damper unit 302, the motors 332 are first fastened to the upright wall 336 and the shafts 460 are mounted to the minor side wall 320 of the frame 306. The hubs 450 are then mounted on the pins 460 and on the first ends 360A of the drive shaft 360. Next, prior to connecting the first and second components 322, 324 of the frame 306 together, the vanes 330 are mounted in the hubs 450. Thereafter, the first and second components 322, 324 are fastened together thereby preventing the vanes 330 from disengaging from the hubs 450.

Figure 14:
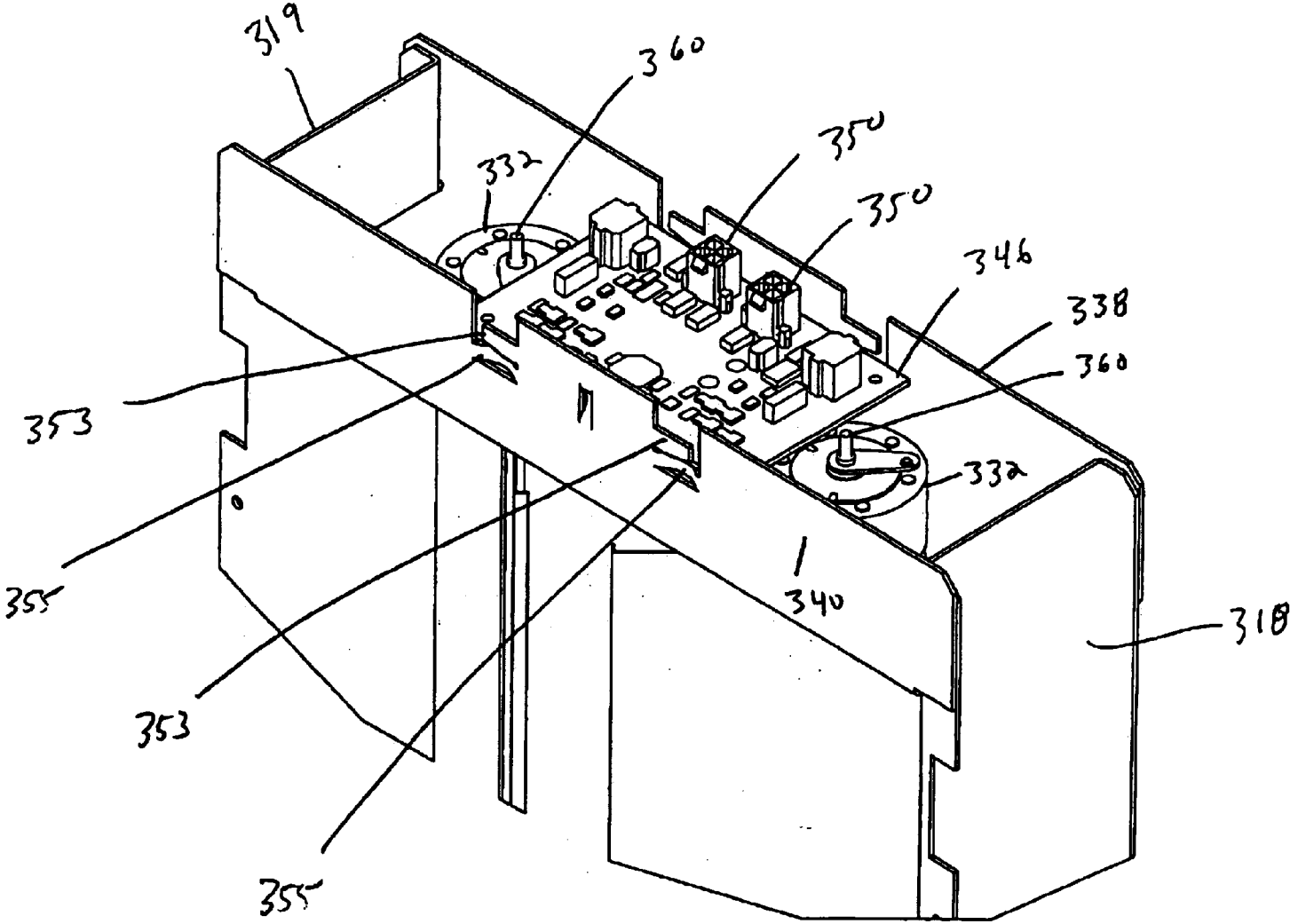
FIG. 14 is a perspective view of the motor housing of FIG. 13.
Figure 17:
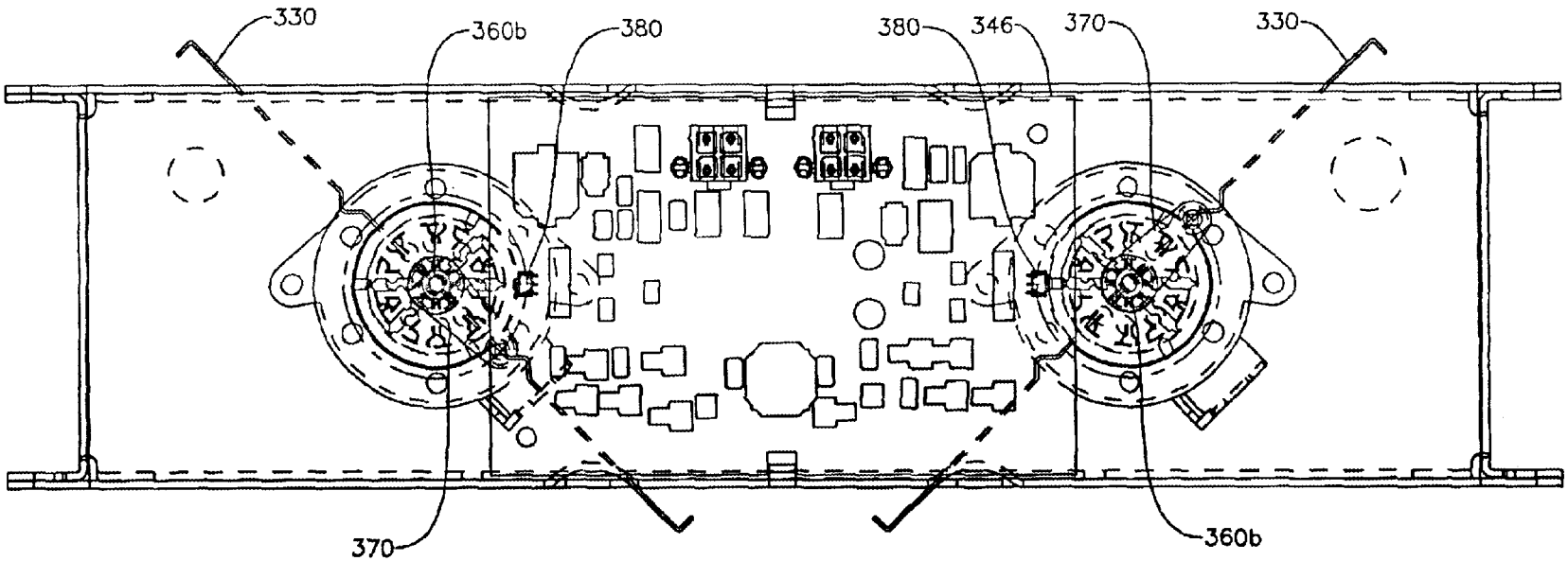
FIG. 17 is a right side view of the damper unit of FIG. 10 with the damper vanes shown in hidden-line.

Referring now to FIGS. 14, 15A and 17, the drive shafts 360 of the drive motors 332 also include second ends 360*b* that project outwardly from the casings 359 into the housing 334. In a preferred embodiment, a rotational position indicator 370 (i.e., a flag), similar to indicator 220 described above, is mounted to the second end 360*b*. In the example shown, two indicators 370 are provided, one for each vane 330. The indicators 370 project perpendicularly outwardly from the shafts 360 and rotate in concert with the shafts 360. Preferably, the indicators 370 are aligned with the damper vanes (see FIG. 17).

As best shown in FIG. 13, portions of each of the motors 332 are positioned beneath the circuit board 346 (i.e., portions of the circuit board 346 cover or overlap the motors 332). With the circuit board 346 so positioned, the rotational position indicators 370 pass beneath the circuit board 346 with each revolution of their corresponding shafts 360. Sensing devices 380 are preferably positioned on the side of the circuit board 346 that faces the motors 332. The sensing devices 380 are adapted to detect each time the rotational position indicators 370 pass by the sensors. As noted above, in one embodiment the sensing devices 380 include Hall Effect sensors, and the rotational position indicators 370 include magnets capable of being sensed by the Hall Effect sensors. In other embodiments, the sensor can include an optical sensor, a proximity sensor, or any number of different types of sensors. As described above, information from the Hall Effect sensors can be used by the controller to reset home positions of the vanes.

FIGS. 21–24 illustrate and alternative damper unit 502 that is equipped with only of the damper vanes 330. It will be appreciated that the damper unit 502 operates in a similar manner to the damper unit 302 previously described.

With regard to the forgoing description, changes may be made in detail, especially with regard to the shape, size, and arrangement of the parts. It is intended that the specification and depicted aspects be considered illustrative only and not limiting with respect to the broad underlying concepts of the present disclosure. Certain inventive aspects of the present disclosure are recited in the claims that follow.

What is claimed is:

1. A damper device for an air sing system, comprising:

a frame defining an air flow opening;

at least one damper vane coupled to the frame;

a motor including a shaft coupled to the vane to move the damper vane
between open and closed positions; and a sensor positioned to sense when the damper vane a home position;

wherein the damper vane moves from a home position in which the sensor senses the damper vane to a second position in which the damper vane is not sensed by any sensor, and back to the home position;

wherein the home position is reset when the sensor senses that the damper vane has reached the home position.

2. The damper of claim 1, further comprising an arm coupled to the shaft and having a magnet positioned thereon, the am being generally aligned with the damper vane and moving as the vane moves from the closed position to the open position.

3. The damper of claim 1, wherein the sensor is a Hall Effect sensor.

4. The damper of claim 1, further comprising a micro-controller coupled to the sensor, the microcontroller resetting the home position upon receipt of an index signal from the sensor.

5. The damper of claim 1, wherein the home position is the closed position.

6. The damper of clam 1, wherein the motor is a stepper motor.

7. A damper device for an air handling system, comprising:

a frame defining an air flow opening;

at least one damper vane coupled to the frame;

a stepper motor including a shaft with a first end extending through hole defined by the frame and being coupled to the damper vane to move the damper vane between open and closed positions, the shaft also including a second end having an am coupled thereto, the arm including a magnet, wherein the arm is generally aligned with the damper vane and rotates with the vane as the shaft moves the vane from die open to the closed position;

a circuit board coupled to the frame and positioned to at least partially overlap the arm, the circuit board including a Hall Effect sensor positioned to sense when the arm with the magnet passes in close proximity thereto; and a microcontroller coupled to the Hall Effect sensor, the microcontroller resetting a home position upon receipt of an index signal from the Hall Effect sensor.

8. A positioning system for a vane of a damper device, comprising:

a Hall Effect sensor configured to sense when a position indicator including a magnet that is coupled to the vane reaches a home position and thereupon generate an index signal; and a microcontroller coupled to the sensor, the microcontroller resetting the home position of the vane upon receipt of the index signal.

9. The system of claim 8, wherein the microcontroller is configured to sense an interval between when the index signal starts and when the index signal ends, and wherein the microcontroller is configured to select a midpoint of the interval as the home position.

10. The system of claim 8, wherein the system is configured to reset the home position upon initialization.

11. A method for controlling a position of a vane of a damper, the method comprising:

providing a magnet to move as the vane moves;

providing a sensor to sense when the magnet comes into close proximity thereto;

moving the vane between an open and a closed position;

generating an index signal when the magnet passes in close proximity to the sensor; and setting a home position based on the index signal.

12. The method of claim 11, wherein the setting step further comprising:

measuring when the index signal starts;

measuring when the index signal ends;

selecting a midpoint between the start and the end of the index signal as the home position; and returning the vane to the home position.

13. A method of positioning a vane of a damper upon initialization, the method comprising:

moving the vane;

generating an index signal when a position indicator coupled to the vane passes in close proximity to x sensing device; and setting a home position based on the index signal.

14. The method of claim 13, wherein the setting step further comprises:

measuring when the index signal starts;

measuring when the index signal ends;

selecting a midpoint between the start and the end of the index signal as the home position; and returning the vane to the home position.

15. A damper device for an air handling system, comprising:

a frame defining an air flow opening;

at least one damper vane coupled to the frame;

a motor including a shaft coupled to the vane to move the damper vane between open and closed positions; and at least one sensor positioned to sense when the damper vane reaches a home position;

wherein the damper vane rotates in a circular path from a home position in which the sensor senses the damper vane to a second position in which the damper vane is not sensed by any sensor in the device, and back to the home position;

wherein the home position is reset when the sensor senses that the damper vane has reached the home position.

* * * * *